US008991468B2

(12) United States Patent
Bolton, III

(10) Patent No.: US 8,991,468 B2
(45) Date of Patent: Mar. 31, 2015

(54) WINDOW SHADE

(71) Applicant: Robert E. Bolton, III, Joliet, IL (US)

(72) Inventor: Robert E. Bolton, III, Joliet, IL (US)

( * ) Notice: Subject to any disclaimer, the term of this patent is extended or adjusted under 35 U.S.C. 154(b) by 114 days.

(21) Appl. No.: 13/772,258

(22) Filed: Feb. 20, 2013

(65) Prior Publication Data

US 2013/0160954 A1 Jun. 27, 2013

Related U.S. Application Data

(63) Continuation-in-part of application No. 13/278,995, filed on Oct. 21, 2011, now abandoned, and a continuation-in-part of application No. 12/457,294, filed on Jun. 5, 2009, now Pat. No. 8,047,254.

(51) Int. Cl.

| | |
|---|---|
| ***E06B 9/30*** | (2006.01) |
| ***E06B 9/24*** | (2006.01) |
| ***E06B 9/323*** | (2006.01) |
| *E06B 9/262* | (2006.01) |

(52) U.S. Cl.

CPC . *E06B 9/24* (2013.01); *E06B 9/323* (2013.01); *E06B 2009/2625* (2013.01)

USPC ..... 160/168.1 R

(58) Field of Classification Search

CPC ..... E06B 9/266; E06B 9/323; E06B 9/324

USPC ..... 160/23.1, 32, 36, 178.2, 178.3 R, 349.2, 160/166.1, 178.1 R, 84.04, 84.05, 170, 34

See application file for complete search history.

(56) References Cited

U.S. PATENT DOCUMENTS

| | | | | |
|---|---|---|---|---|
| 1,804,864 | A | 5/1931 | Ellis | |
| 2,370,794 | A | 3/1945 | Houmere | |
| 2,884,052 | A * | 4/1959 | Lando et al. | 160/168.1 R |
| 2,896,893 | A | 7/1959 | Mariano | |
| 4,062,483 | A | 12/1977 | Brigante | |
| 4,079,772 | A | 3/1978 | Klaenhammer et al. | |
| 4,397,346 | A | 8/1983 | Chumbley et al. | |
| 4,802,523 | A | 2/1989 | Scholten et al. | |
| 4,886,104 | A | 12/1989 | Eldridge, Jr. | |
| 5,158,127 | A | 10/1992 | Schumacher | |
| 5,170,830 | A | 12/1992 | Coslettt | |
| 5,199,230 | A | 4/1993 | Gehman | |
| 5,211,442 | A | 5/1993 | Shikano | |
| 5,769,142 | A | 6/1998 | Nicolosi | |
| 5,860,466 | A | 1/1999 | Kao | |
| 5,937,929 | A * | 8/1999 | Chen | 160/370.23 |
| 6,095,223 | A | 8/2000 | Rossini et al. | |
| 6,192,961 | B1 | 2/2001 | Martinez | |

(Continued)

FOREIGN PATENT DOCUMENTS

DE 2921608 12/1980

*Primary Examiner* — Blair M Johnson

(57) ABSTRACT

The window shade includes a header defined by a substantially elongated U-shaped channel. The top of the header includes attachment areas for attaching the header to a window frame. A folded blind has one end attached to the web of the header channel, and when folded, the blind is housed inside the channel. The other end of the pleated blind is attached to a footer. A magnetic latching assembly is disposed between the header and the footer to keep the blind in a folded condition. Alternatively, a retaining mechanism holds the footer when the blind is folded. Pulling a pull cord or handle disposed on the footer releases the magnetic latching mechanism or the retaining mechanism to thereby rapidly unfold the blind.

7 Claims, 8 Drawing Sheets

(56) References Cited

U.S. PATENT DOCUMENTS

| | | | | |
|---|---|---|---|---|
| 6,339,904 | B1 | 1/2002 | Carrone et al. | |
| 6,405,781 | B2 * | 6/2002 | Davies et al. | 160/23.1 |
| 6,422,286 | B1 * | 7/2002 | Osterberg | 160/23.1 |
| 6,994,143 | B2 | 2/2006 | McCarty et al. | |
| 7,114,545 | B2 | 10/2006 | Null | |
| 7,225,850 | B2 | 6/2007 | McCarty et al. | |
| 8,047,254 | B2 | 11/2011 | Bolton, III | |
| 8,096,340 | B2 | 1/2012 | McCarty et al. | |
| 2003/0127200 | A1 | 7/2003 | Aguilar | |
| 2005/0022942 | A1 | 2/2005 | Heitel | |
| 2005/0056380 | A1 | 3/2005 | Hsu | |
| 2005/0109468 | A1 | 5/2005 | Hsu | |
| 2005/0205217 | A1 | 9/2005 | Harper et al. | |
| 2006/0086469 | A1 | 4/2006 | Nien | |
| 2006/0191646 | A1 | 8/2006 | Harper et al. | |
| 2006/0289125 | A1 | 12/2006 | Kollman et al. | |
| 2007/0023151 | A1 | 2/2007 | Judkins | |
| 2008/0035279 | A1 | 2/2008 | Gardner et al. | |
| 2008/0216966 | A1 | 9/2008 | Ben-David | |
| 2012/0037320 | A1 | 2/2012 | Bolton, III | |
| 2013/0160954 | A1 * | 6/2013 | Bolton, III | 160/84.04 |

* cited by examiner

WINDOW SHADE

CROSS REFERENCE TO RELATED APPLICATIONS

This is a continuation-in-part of my prior U.S. patent application Ser. No. 13/278,995, filed on Oct. 21, 2011, now pending, which is a continuation-in-part of U.S. patent application Ser. No. 12/457,294, filed on Jun. 5, 2009, now U.S. Pat. No. 8,047,254.

BACKGROUND OF THE INVENTION

1. Field of the Invention

The present invention relates to window shades, and more specifically to an economical magnetic cordless shade for fast deployment whenever shade or cover is desired.

2. Description of the Related Art

In most situations where danger is from outside, the windows of a building pose the biggest threat to the occupants. Unless reinforced, the windows can easily be breached, and they provide a view of the occupants therein for potential enemies outside. Since most windows include a blind for shade or privacy purposes, it is common practice to cover the windows in emergency or dangerous situations. The blind, typically Venetian or roll-up blinds, provides a barrier from potentially harmful debris should the window break or shatter as well as obscure the view. Rapid deployment of the blind is advantageous in these situations, but due to the construction of a Venetian blind, the catch mechanism often hinders fast release of the slats. With respect to a roll-up blind, the reeling mechanism is prone to wear so that reeling and un-reeling becomes unreliable. In many facilities, such as schools, office buildings, and the like, lock down procedures typically call for windows, and particularly windows disposed in classroom or office doors, to be covered as quickly as possible. Thus, it would be a benefit in the art to provide a window shade that can easily and reliably deploy in a rapid manner while minimizing costs for the same.

Thus, a window shade solving the aforementioned problems is desired.

SUMMARY OF THE INVENTION

The window shade includes a header defined by a substantially elongated U-shaped channel. The top of the header includes attachment areas for attaching the header to a window frame. A folded blind has one end attached to the web of the header channel, and when folded, the blind is housed inside the channel. The other end of the pleated blind is attached to a footer. A magnetic latching assembly is disposed between the header and the footer to keep the blind in a folded condition. Alternatively, a retaining mechanism holds the footer when the blind is folded. Pulling a pull cord or handle disposed on the footer releases the magnetic latching mechanism or the retaining mechanism to thereby rapidly unfold the blind.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
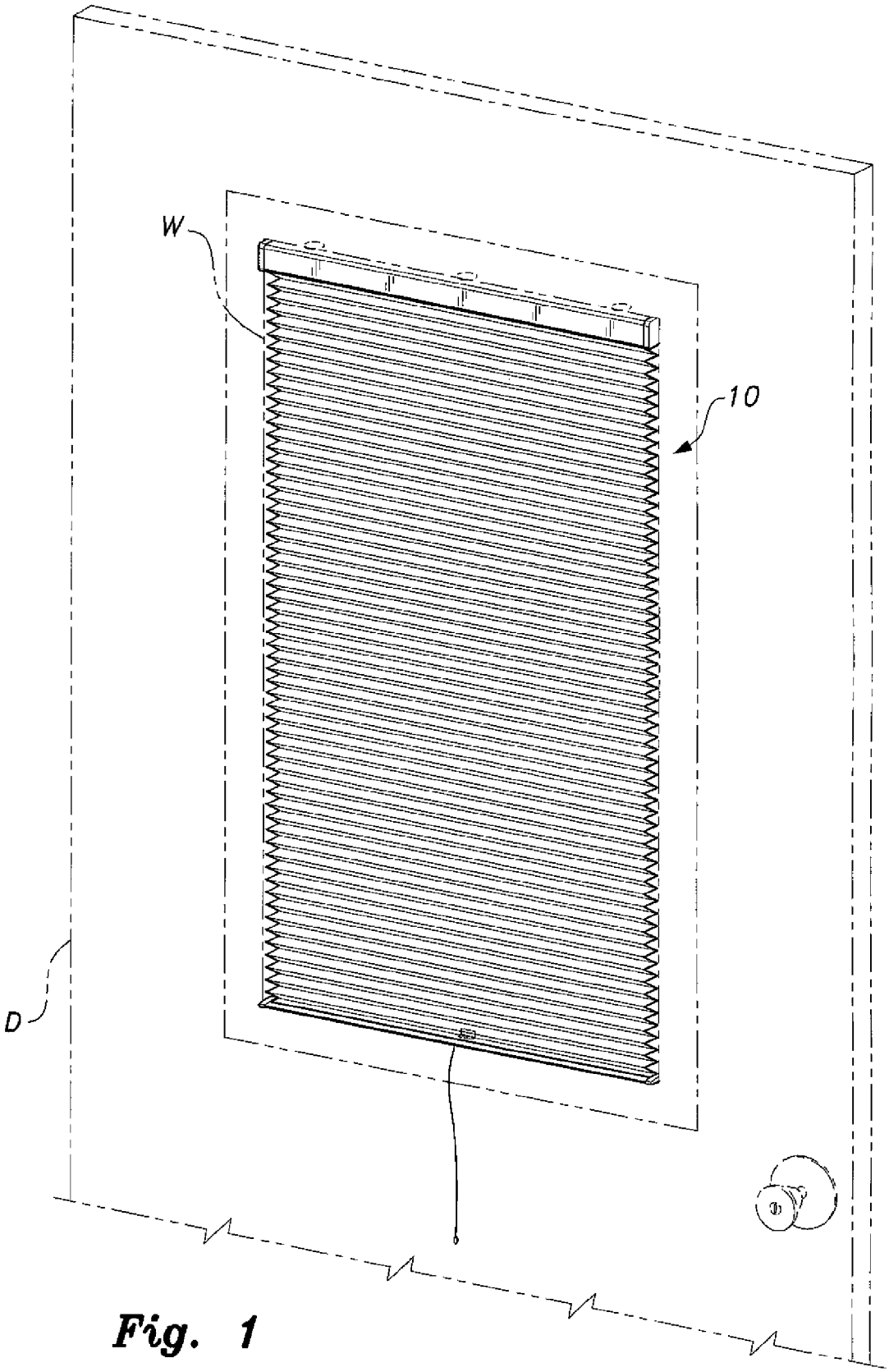
FIG. 1 is an environmental, perspective view of a magnetic cordless shade according to the present invention.
Figure 2:
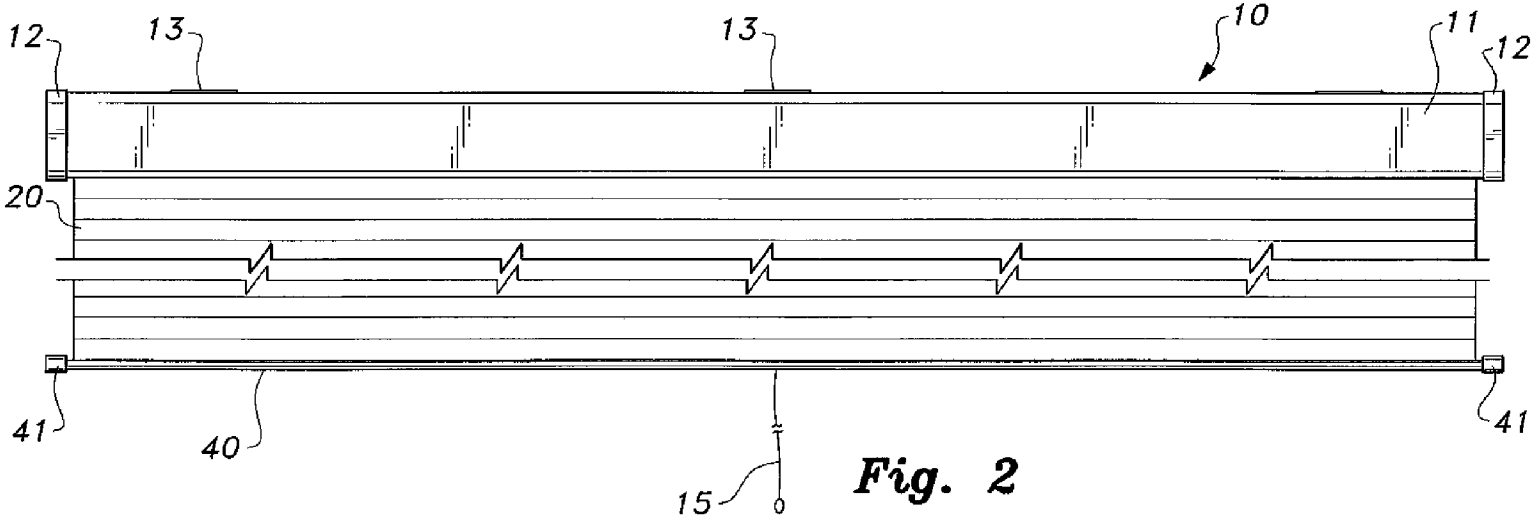
FIG. 2 is a partial front view of the magnetic cordless shade according to the present invention.
Figure 3:
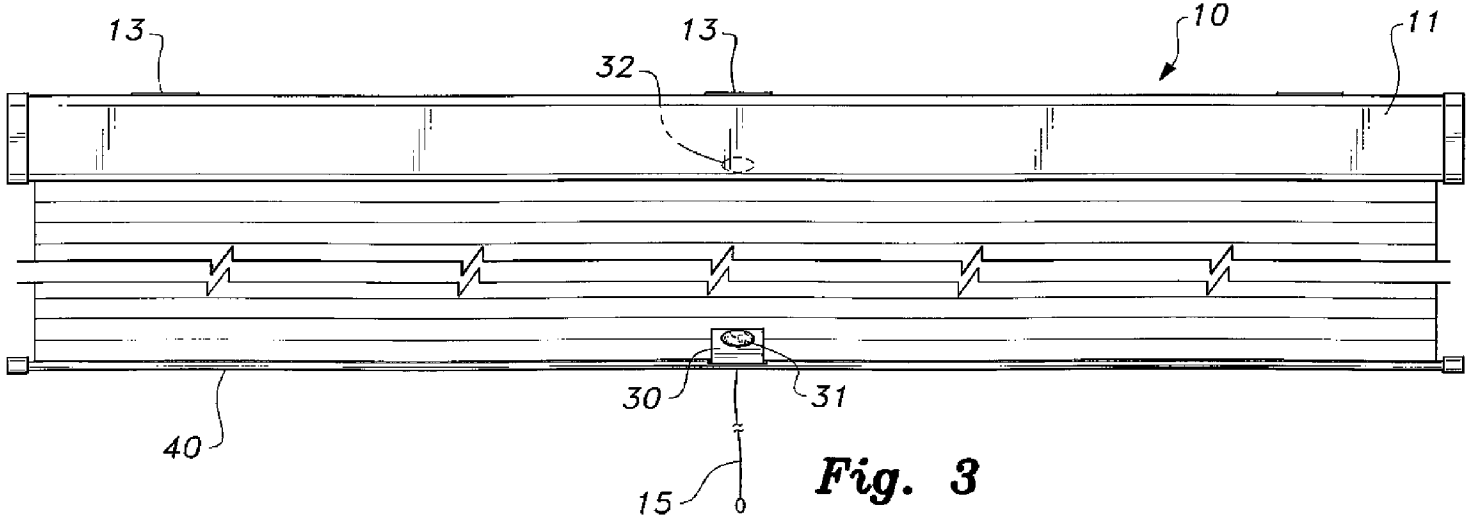
FIG. 3 is a partial rear view of the magnetic cordless shade according to the present invention.

The present invention relates to a rapidly deployable magnetic cordless shade, generally referred to by reference number 10, which is simple in construction and cost effective. As shown in FIGS. 1-4, the magnetic cordless shade 10 includes a header or head rail 11, a footer or foot rail 40 and a blind 20 disposed between the head and foot rails 11, 40. The head rail 11 is an elongate, U-shaped channel formed from a web and two substantially parallel flanges extending from opposite edges of the web, the channel having an interior defining a housing space for the blind 20. The head rail 11 is adapted to be mounted to the top of a window frame. To facilitate the mounting, the head rail 11 includes attachment areas 13 where fasteners or adhesives may be used to attach the head rail 11 to the window frame. Alternatively, one of the sides of the head rail 11 may include attachment areas to facilitate mounting the head rail 11 above a window niche. Another alternative may employ hanging brackets for the head rail 11. The distal ends of the head rail 11 may be covered by end caps 12.

The blind 20 is preferably a folded stack of fabric, or pleated fabric, that will stow inside the housing area of the head rail 11 when in a folded condition. The fabric may be made from paper, textile, vinyl or composites so long as it is durable and provides shade. An anchoring upper vane or slat 21 is attached to the upper end of the blind 20. The upper anchoring slat 21, in turn, is fixed to the web 17 of the header rail 11 by fasteners or adhesives. The lower end of the blind 20 is attached to another anchoring vane or slat 22

The footer or foot rail 40 is an elongate channel dimensioned to slidably fit over the lower anchoring slat 22. The two anchoring slats 21, 22 on the respective rails provide a stable connection so that the blind 20 may easily unfold or fold. A pull cord 15 is operatively disposed on the foot rail 40. The foot rail 40 may also include end caps 41 to cover the distal ends.

Figure 4:
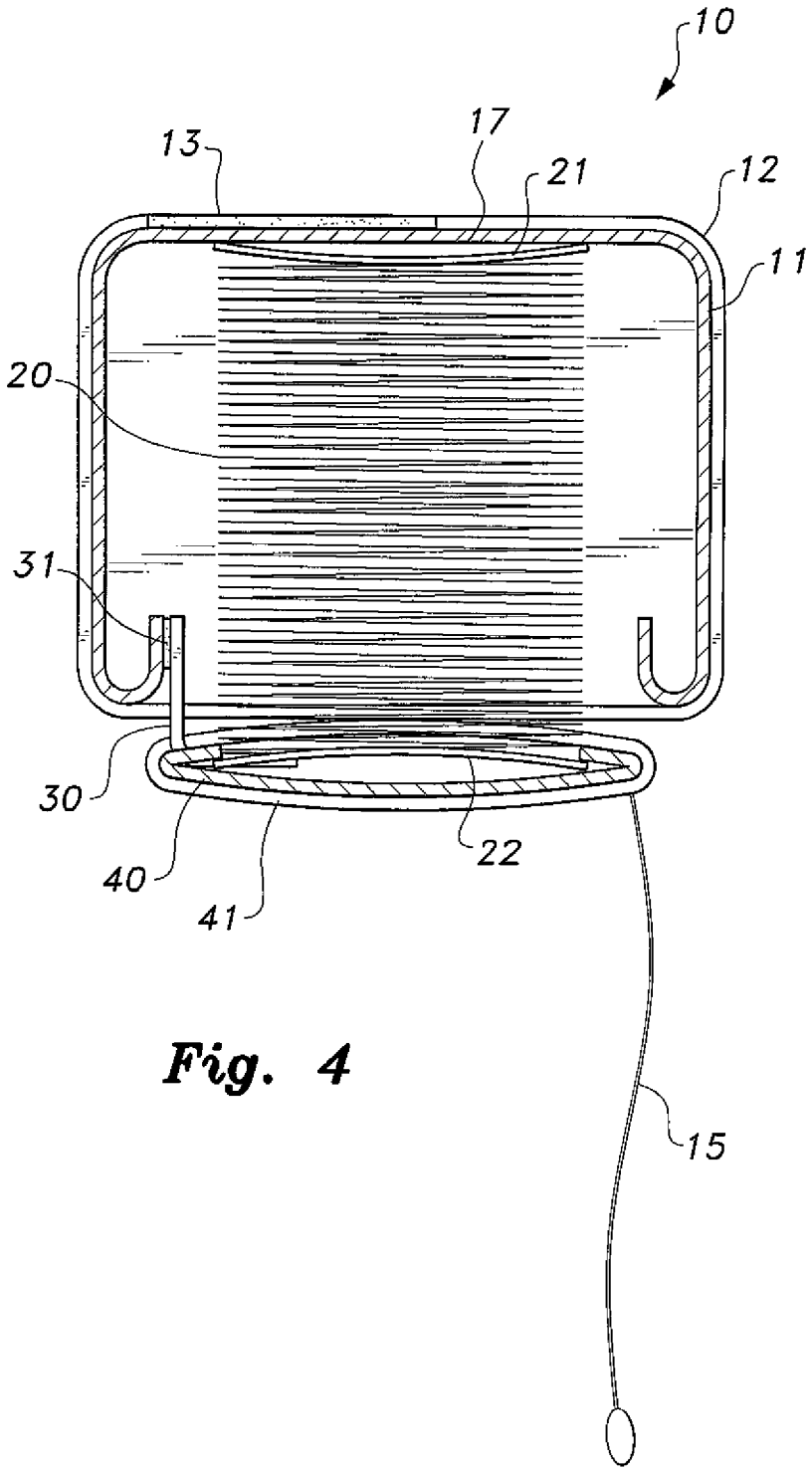
FIG. 4 is a side view in section of the magnetic cordless shade according to the present invention, the shade being retracted into the header channel.
Figure 5A:
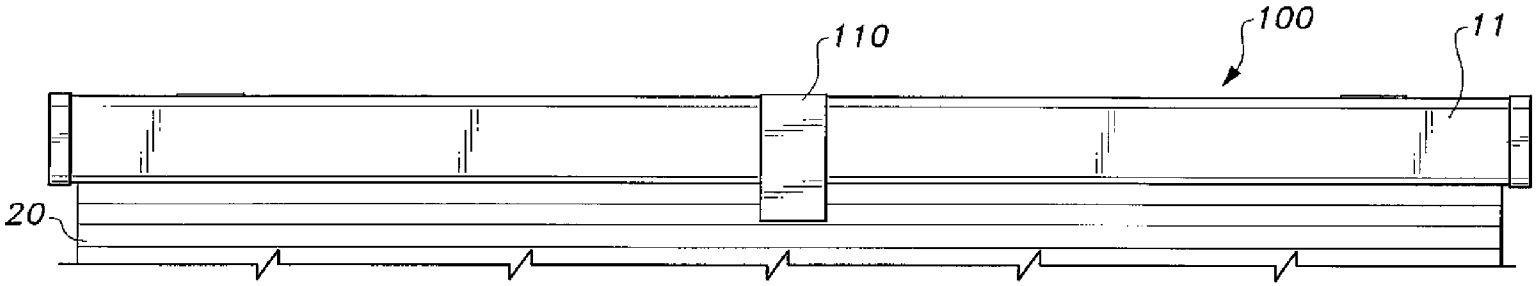
FIG. 5A is a rear view of an alternative embodiment of a magnetic cordless shade according to the present invention.
Figure 5B:
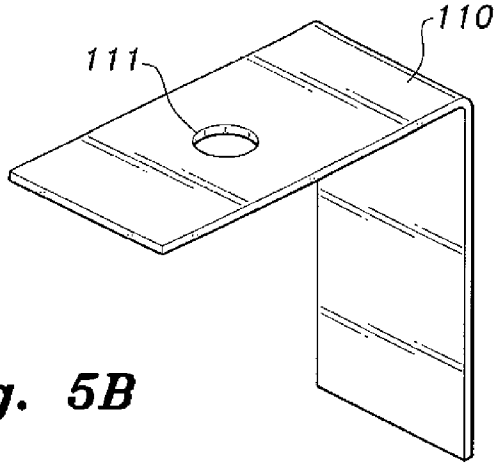
FIG. 5B is a perspective view of a metal latch locking bracket of the alternative embodiment of the magnetic cordless shade shown in FIG. 5A.

To keep the blind 20 in a stowed or folded condition, the magnetic cordless shade 10 includes a magnetic latching assembly disposed between, or having mating components attached to or formed by, the header and the footer 11, 40. The magnetic latching assembly includes a magnetic latch 30 disposed on the foot rail 40. The magnetic latch 30 may be a folded bracket with a magnet 31 mounted or bonded thereon. The magnet 31 is preferably a neodymium magnet. If the head rail 11 is made from a ferromagnetic material, such as steel, then the magnetic latch 30 may simply latch to the interior of head rail 11, as shown in FIG. 4. For other instances, such as a head rail 11 made from aluminum or plastic, the head rail 11 may include a magnetic locking latch 32, keeper, or catch mounted inside the head rail 11. The magnetic locking latch 32 is preferably a strip of ferromagnetic material or an oppositely polarized magnet. To ensure unobtrusive latching between the rails 11 and 40, the head rail 11 may include a slot through which the magnetic latch 30 may pass.

The following describes operation of the magnetic cordless shade 10. As shown in FIG. 4, the magnetic cordless shade 10 is assumed to be in a folded condition with the magnetic latch 30 locked onto the head rail 11. When it is desired to rapidly cover the window W, e.g., a window on a door D (shown in FIG. 1), the user pulls a handling means such as a handle or the pull cord 15 with enough force to release the magnetic latch 30 to allow the weight of the foot rail 40 and gravity assist with unfolding and extending or lowering the blind 20. Thus, the blind 20 is rapidly deployed with minimal or any hindrance. When shade or cover is no longer needed, the user lifts the foot rail 40 and folds the blind 20 back into the channel and secures the magnetic latch 30.

Figure 6A:
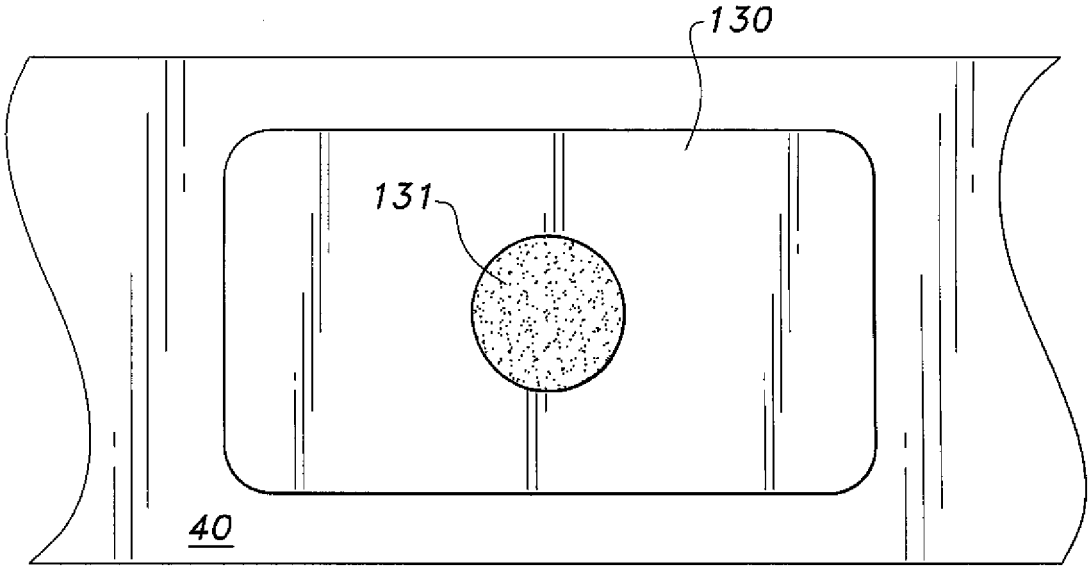
FIG. 6A is a front view of an alternative embodiment of a magnetic latch for a magnetic cordless shade according to the present invention.
Figure 6B:
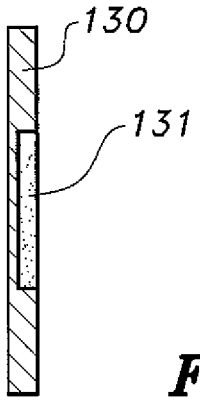
FIG. 6B is a side view in section of the alternative magnetic latch of FIG. 6A.

Referring to FIGS. 5A-6B, alternative magnetic latching assemblies for the magnetic cordless shade 10 are shown. For example, in FIGS. 5A and 5B, the magnetic cordless shade 100 includes a magnetic locking latch 110. The magnetic locking latch 110 may be a L-shaped bracket mounted to the exterior of the head rail 11 by a fastener inserted through fastener hole 111, the bracket being made from ferromagnetic material. In operation, the magnetic latch 30 latches onto the depending portion or downwardly extending leg of the bracket. Also, as shown in FIGS. 6A and 6B, the magnetic latch 130 may be a strip of material of any desired shape that is attached to the foot rail 40. A magnet 131 is embedded in the strip and functions similar to the above magnetic latch 30.

Similar quick-release deployment of the blind can also be provided with non-magnetic means. In the embodiment shown in FIGS. 7 and 8, the alternative window shade, generally designated by the reference number 200, includes a mechanical retaining mechanism that retains the blind in a stowed position, yet allows for rapid deployment of the blind by a gentle tug on the footer.

Figure 7:
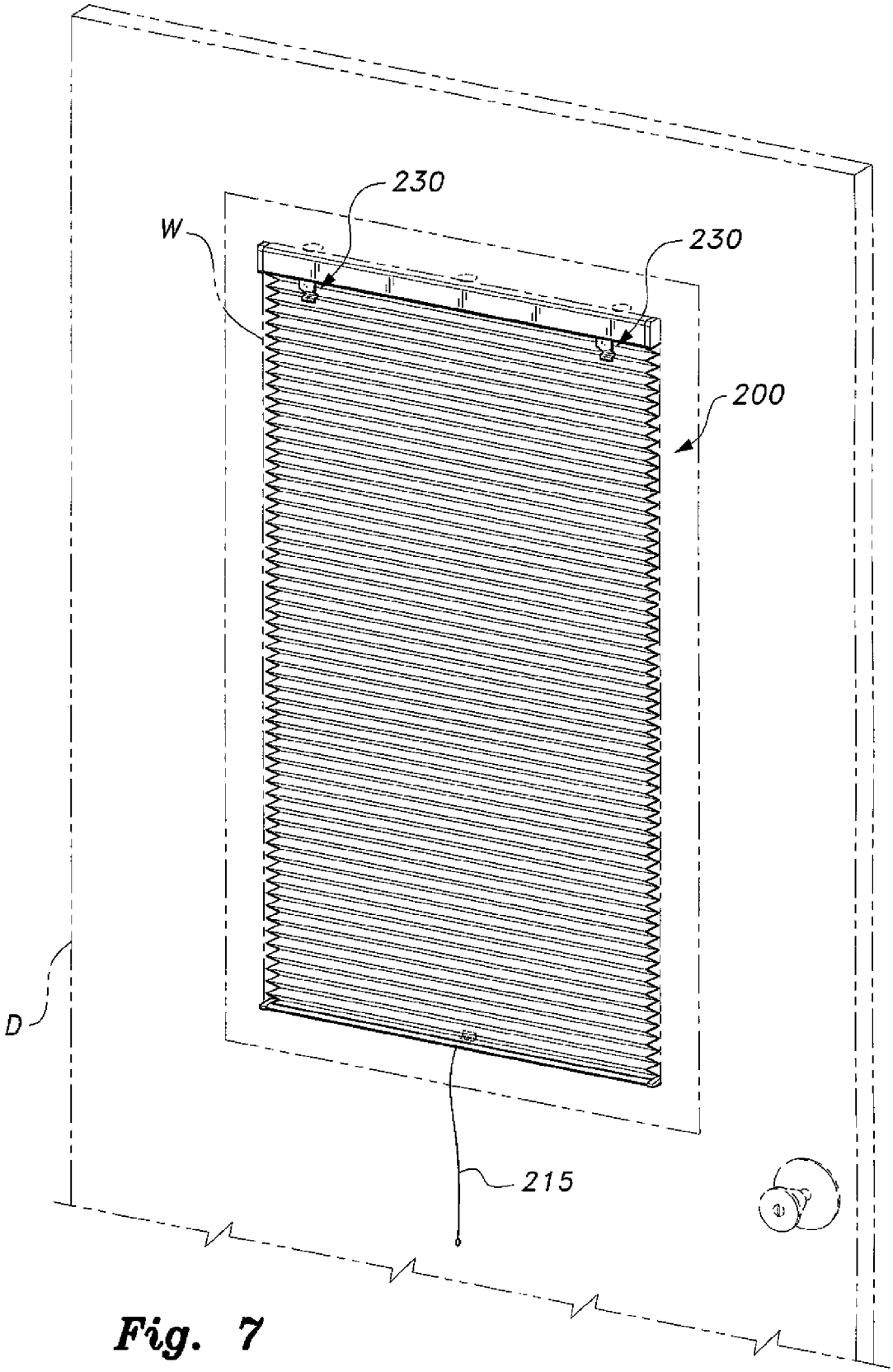
FIG. 7 is an environmental perspective view of another alternative embodiment of a window shade according to the present invention.
Figure 8:
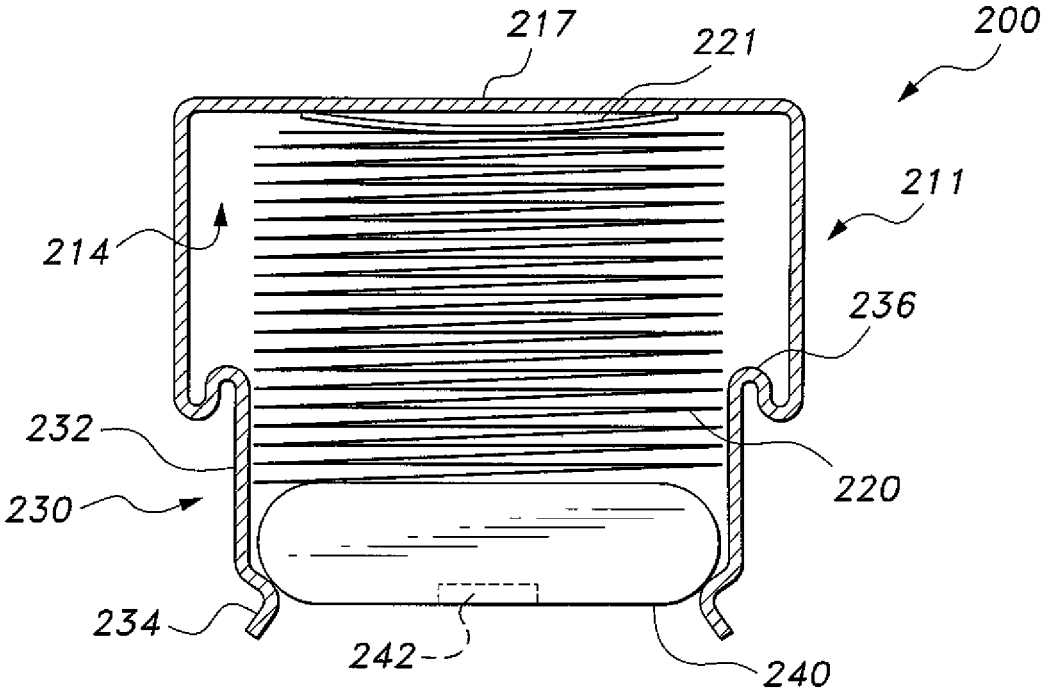
FIG. 8 is a side view in section of the window shade of FIG. 7, the shade being retracted into the header channel.

As shown in FIGS. 7 and 8, the window shade 200 includes a header or head rail 211, a footer or foot rail 240 and a blind or shade 220 disposed between the head and foot rails 211, 240. The head rail 211 is substantially similar to the previously described head rail 11 in that the head rail 211 includes an elongate, U-shaped channel formed from a web and two substantially parallel flanges extending from opposite edges of the web, the channel having an interior defining a housing space 214 for the blind 220. The head rail 211 is configured to be mounted to the top sill of a window frame in the same manner described above with respect to the head rail 11.

The blind 220 is preferably similar in construction to the blind 20. The blind 220 is a folded stack of fabric or material that will stow inside the housing area 214 when in a folded condition. The blind 220 can be attached to the head rail 211 by respective anchoring vanes or slats, such as the slat 221 for the upper end of the blind 220.

As noted above, the folded blind 220 is retained in the housing area 214 by a retaining mechanism 230. In this embodiment, the retaining mechanism 230 includes at least one elongate spring clip 232 extending downward from select locations along the length of the head rail 211. As shown, the spring clip 232 is integrally formed with the head rail 211 and includes an upper curved portion 236 and a lower curved lip 234 extending outward at an angle. The upper curved portion 236 provides the resilient biasing force required to facilitate holding or retention of the foot rail 240. Although the drawings show the spring clip 232 being substantially vertical, the spring clip 232 can also be angled inward towards the vertical center of the head rail 211 for additional bias. The lower lip 234 is preferably curved to provide a ledge for the foot rail 240 when placed in the stowed position and to allow for relatively easy insertion or release of the foot rail 240 towards or away from the housing area 214. The spring clips 232 can be constructed from the same material as the head rail 211, or from plastic, wood, steel, composites and combinations thereof.

In operation, the user simply tugs or pulls on a handling means such as a handle or a pull cord 215 operatively attached to the foot rail 240 with enough force to overcome the bias of the spring clips 232, which causes the blind 220 to rapidly unfold and cover the window W due to the falling weight of the foot rail 240. Optionally, the foot rail 240 can include a magnet 242 imbedded therein or otherwise attached to the foot rail 240 in order to secure the foot rail 240 onto the bottom sill of the window W, if the bottom sill is ferromagnetic. When it is desired to open the shade, the user pushes the foot rail 240 up towards the head rail 211 causing the blind 220 to fold along the way. The user then pushes the foot rail 240 against the lips 234 of the spring clips 232 past the curved portion thereof until secured by the spring clips 232.

Although an integral spring clip 232 has been described, the retaining mechanism 230 includes a variety of alternatives. For example, the spring clips 232 can be a separate element that can be attached to the head rail 211 by coil springs, which bias the elongate clip 232 against the sides of the blind 220 and the foot rail 240. In addition, any number and widths of the spring clips 232 can be disposed along the length of the head rail 211.

Figure 9:
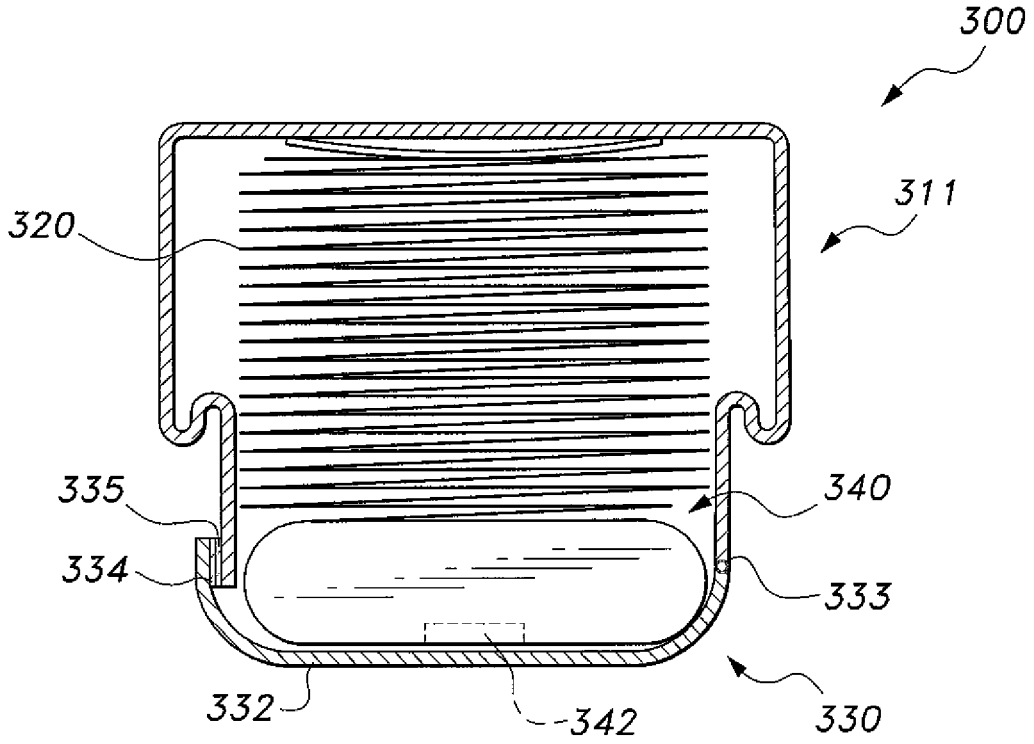
FIG. 9 is a side view in section of another alternative embodiment of a window shade according to the present invention, the shade being retracted into the header channel and having a different latching mechanism than the embodiment of FIG. 8.

A still further example of a quick-release retaining mechanism is shown in FIG. 9. In this embodiment, the window shade 300 includes a header or head rail 311, a footer or foot rail 340, and a foldable blind 320 attached therebetween. At least one retaining mechanism 330 is pivotally attached to one side of the head rail 311 by a pivot 333. The pivot 333 can be a hinge-type of connection having a hinge pin, or a living hinge. The retaining mechanism 330 includes an elongate retaining strip 332 pivotally attached to the pivot 333 at one end. The retaining strip 332 holds or retains the foot rail 340 when the blind 320 is folded into the stowed position. The other end of the retaining strip 332 includes a magnet 334 for securing that end of the retaining strip 332 against the head rail 311 by mutual attraction with a second magnet 335 of opposite polarity attached to the head rail 311. The magnets 334, 335 are preferably mild in strength so as to minimize the tugging or pulling force required to deploy the blind 320. Alternatively, the second magnet 335 can be replaced by a strip of ferromagnetic material. As a further alternative, the arrangement of the magnet and ferromagnetic material can be reversed between the retaining strip 332 and the head rail 311.

Figure 10:
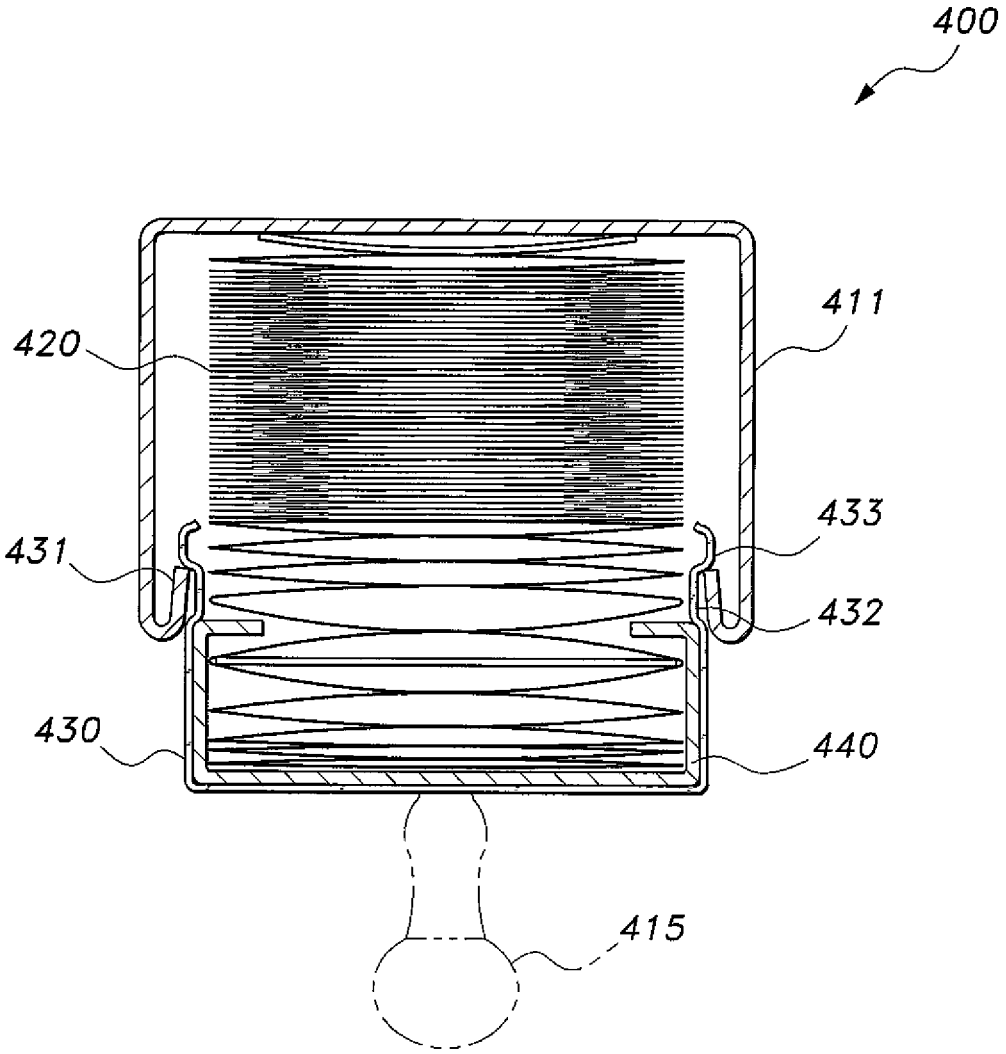
FIG. 10 is a side view in section of another alternative embodiment of a window shade according to the present invention, the shade being retracted into the header channel and having a different latching mechanism than the embodiments of FIGS. 8 and 9.

A still further example of a quick-release retaining mechanism is shown in FIG. 10. In this embodiment, the window shade 400 includes a header or head rail 411, a footer or foot rail 440, and a foldable blind 420 attached therebetween. The at least one retaining mechanism 430 is attached to the footer or foot rail 440. The retaining mechanism 430 includes a U-shaped spring clip. The U portion of the clip is securely attached to the bottom surface of the foot rail 440, and the resilient arms 432 include retainer beads 433 that are engaged by a flange 431 located in header or head rail 411. The spring clip holds or retains the foot rail 440 when the blind 420 is folded into the stowed position. As with the other embodiments, magnets may be used to further secure the blind 420 within the head rail 420. The foot rail 440 may have a handle 415 or a pull cord 15 extending therefrom so that the user can conveniently grasp the handle 415 or cord 15 to pull the blind 420 down when desired.

Referring further to FIG. 10, the exemplary header 411 has an inverted U-shape, and the flanges 431 form hooks that extend inward into the channel formed by the header 411. The exemplary footer 440 is also U-shaped, and also has flanges at the upper ends, the flanges extending orthogonally inward at the upper ends of the footer 440. The spring clip of the retaining mechanism 430 is U-shaped, having a bight and opposing, generally parallel arms. The arms of the spring clip have a lower flat portion that closely engage the parallel arms of the footer, then an inwardly extending portion that curves inward over the corners formed by the orthogonal, inwardly extending flanges of the footer 440, an offset portion that extends vertically upward in a plane parallel to the lower flat portion, and the outwardly extending bead formed at the upper end of the spring clip arms. The curved portions of the spring clip arms between the lower flat portion and the offset vertical portion resiliently retain the spring clip on the footer 440. The hooked lower ends of the header 411 slide over the beads 433, which resiliently extend outward, the ends of the hooks snapping into place against the beads 433 to hook the footer 440 onto the header 411. When the user pulls the handle 415 or the pull cord 15, the resilient arms of the spring clip bend inward and the beads 433 slide down the hooked flanges 431 of the header 411 to release the footer 440 and extend the blind 420. Although the footer 440 and the spring clip of the retaining mechanism 430 are shown having a rectilinear or box-shaped configuration in the drawing, it will be understood that the footer 440 and the retaining mechanism may have any desired configuration, provided that the spring clip closely conforms to the shape of the footer 440. Further, although the spring clip has been described as resiliently engaging the footer 440, it will be understood that the spring clips may be rigidly or permanently attached to the footer 440, provided that the arms of the spring clip resiliently engage the header 411.

In most respects, the window shade 300, 400 operates in the same manner as the window shade 200. An additional step is in securing the folded blind 320, 420 and the foot rail 340, 440 against the head rail 311, 411 by manually strapping the retaining strips 332 with the magnets 334, 335 or resiliently clipping the retainer beads 433 onto the flange 431. Moreover, the foot rail 340 can also include a magnet 342 for securing the foot rail 340 against a ferromagnetic, bottom window sill when fully deployed. The same can be provided for the foot rail 440 as an added securing measure for the foot rail 440. Generally, the weight of the handle 415 in combination with the weight of the foot rail 440 should be sufficient in keeping the blind 420 in the fully deployed state.

Although the above has been described using magnets for securing the retaining strip 332, other types of quick release connectors can be used. For example, the retaining strip 332 can be secured by snaps, quick-release buckles, or mild hook and loop fasteners. The retaining strip 332 can be constructed from similar material as the header rail 311, such as plastic, wood, steel, composites or combinations thereof. Moreover, the retaining strip 332 can be flexible or stiff, and be provided in a variety of sizes and widths.

Thus, it can be seen that the magnetic cordless blind 10 and the window shades 200, 300, 400 are relatively simple in construction. In terms of costs, the magnetic cordless blind 10 and the window shades 200, 300, 400 are very cost effective compared to Venetian blinds due to the customization options offered thereby. The costs of a custom Venetian blind increase when the width is narrower than standard, due in part to the hardware associated therewith, i.e., the cords that pull or lower the slats and custom slats to accommodate the cords. In contrast, the magnetic cordless blind 10 and the window shades 200, 300, 400 do not include such hardware considerations for the custom dimensions.

It is to be understood that magnetic cordless blind 10 and the window shades 200, 300, 400 encompass a variety of other alternatives. For example, the head rail 11 may include a similar strip as that of the magnetic latch 130 so long as the magnet is of opposite polarity. Moreover, the blinds 20, 220, 320, 420 may include a variety of colors and patterns. Furthermore, the magnetic cordless blind 10 and the window shades 200, 300, 400 may come in a variety colors, including indicia for advertising or personalization.

It is to be understood that the present invention is not limited to the embodiments described above, but encompasses any and all embodiments within the scope of the following claims.

I claim:

1. A window shade, consisting of:

a header adapted to be mounted to a window frame or niche, the header including an elongated U-shaped channel formed by a web and two substantially parallel opposing flanges extending from opposite sides of the web, the channel defining a housing area for stowing the shade when retracted;

a footer disposed below the header, the footer having a handling means for pulling the footer;

a window shade, the shade defining a foldable blind attached at its upper end to the header and at its lower end to the footer, thereby extending between the header and the footer, the blind having a retracted position when the blind is folded within the channel and an extended position substantially covering the window frame; and a retaining means for selectively holding the blind folded in the channel defined by the header and selectively holding the footer attached to the header when the blind is in the retracted position, the retaining means comprising;

at least one retaining clip disposed at select locations along said header, the retaining clip being an elongate vertical strip extending from a bottom end of a corresponding flange, the retaining clip having a resiliently biased bottom end for holding said footer and a lower curved lip defining a ledge, said footer resting on the ledge when the blind is in the retracted position, the lower lip easing insertion of said footer into the channel;

wherein pulling the handling means releases the retaining means to rapidly extend the blind.

2. The window shade according to claim 1, wherein said handling means comprises a handle.

3. The window shade according to claim 1, wherein said handling means comprises a pull cord.

4. A window shade, consisting of:

a header adapted to be mounted to a window frame or niche, the header including an elongated U-shaped channel formed by a web and two substantially parallel opposing flanges extending from opposite sides of the web, the channel defining a housing area for stowing the shade when retracted;

a footer disposed below the header, the footer having a handling means for pulling the footer;

a window shade, the shade defining a foldable blind attached at its upper end to the header and at its lower end to the footer, thereby extending between the header and the footer, the blind having a retracted position when the blind is folded within the channel and an extended position substantially covering the window frame; and a retaining means for selectively holding the blind folded in the channel defined by the header and selectively holding the footer attached to the header when the blind is in the retracted position, the retaining means comprising;

at least one retaining clip disposed at select locations along said footer, the retaining clip being an elongate strip shaped to support said footer and having at least one resiliently biased end for holding said footer in the retracted position;

wherein pulling the handling means releases the retaining means to rapidly extend the blind.

5. The window shade according to claim 4, wherein each said retaining clip comprises a U-shaped spring clip having a U portion securely attached to a bottom surface of said footer, said at least one biased end being a pair of parallel spaced resilient arms, the resilient arms each having at least one retainer bead selectively engaged with said header flanges when said shade is in the retracted position.

6. The window shade according to claim 4, wherein said retaining means further comprises a mating pair of magnets.

7. A window shade, consisting of:

a header adapted to be mounted to a window frame or niche, the header including an elongated U-shaped channel formed by a web and two substantially parallel opposing flanges extending from opposite sides of the web, the channel defining a housing area for stowing the shade when retracted;

a footer disposed below the header, the footer having a handling means for pulling the footer;

a window shade, the shade defining a foldable blind attached at its upper end to the header and at its lower end to the footer, thereby extending between the header and the footer, the blind having a retracted position when the blind is folded within the channel and an extended position substantially covering the window frame; and a retaining means for selectively holding the blind folded in the channel defined by the header and selectively holding the footer attached to the header when the blind is in the retracted position, wherein the flanges of said header have hooked ends extending into the channel defined by said header, said retaining means comprising;

at least one U-shaped spring clip having a lower portion resiliently engaging said footer and resilient arms extending above the footer, the resilient arms terminating in outwardly extending beads, the hooked ends of the header flanges selectively engaging the beads to retain the blind in the retracted position, the arms resiliently bending inward so that the beads slide past the hooked ends of the header flanges to release the blind into the extended position when the footer is pulled away from said header;

wherein pulling the handling means releases the retaining means to rapidly extend the blind.

* * * * *